US005795245A

United States Patent [19]

Chang et al.

[11] Patent Number: 5,795,245

[45] Date of Patent: Aug. 18, 1998

[54] NECK WEIGHTING STRUCTURE FOR GOLF CLUBS

[75] Inventors: Poh-Heng Chang, Melaka, Malaysia; Chung-Jong Sung, Tainan, Taiwan

[73] Assignee: Sung Ling Golf & Casting Co., Ltd., Taiwan

[21] Appl. No.: 768,816

[22] Filed: Dec. 18, 1996

[51] Int. Cl.[6] ..... A63B 53/04

[52] U.S. Cl. ..... 473/335; 473/334

[58] Field of Search ..... 473/324, 334, 473/335, 336, 337, 349

[56] References Cited

U.S. PATENT DOCUMENTS

| | | | |
|---|---|---|---|
| 2,683,036 | 7/1954 | Klein | 473/349 |
| 3,419,275 | 12/1968 | Winkleman | 473/335 |
| 4,754,977 | 7/1988 | Sahm | 473/337 |
| 5,297,794 | 3/1994 | Lu | 473/337 |
| 5,332,214 | 7/1994 | Tucker, Sr. | 473/337 X |
| 5,395,113 | 3/1995 | Antonious | 473/324 |
| 5,518,241 | 5/1996 | McHale | 473/324 X |
| 5,547,426 | 8/1996 | Wood | 473/349 X |
| 5,564,705 | 10/1996 | Kobayashi et al. | 473/334 |

*Primary Examiner*—Raleigh W. Chiu
*Attorney, Agent, or Firm*—Varndell Legal Group

[57] ABSTRACT

An improved neck weighting structure for golf club heads includes a neck, a neck weighting and a weight chamber. The neck extends from a shaft mount towards the lower rim of the sole of the golf club head and straddles the lower rim of the sole to reduce the gravitational center of the club head. The neck weighting projects from the neck near the shaft mount to cause the gravitational center to deviate towards the extended line of the head. The weight chamber accommodates weights of various mass for correcting the position of the gravitational center.

2 Claims, 4 Drawing Sheets

NECK WEIGHTING STRUCTURE FOR GOLF CLUBS

BACKGROUND OF THE INVENTION

The present invention relates generally to an improved neck weighting structure for golf club heads and, more particularly, to an improved neck weighting structure that can effectively correct the position of the gravitational center of the golf club head.

The structure of the head of a golf club is a factor determining the accuracy of the stroke with the club. If the impact on the golf ball made by the head is insufficient, the golf ball will slip. And if the gravitational center of the head deviates excessively from the extended line of the club, torsion will be generated when the golf ball is struck, so that the golf ball cannot achieve the best flight path

SUMMARY OF THE INVENTION

A primary object of the present invention is to provide an improved neck weighting structure for golf club heads, which can effectively increase the weight of the neck of the club head for lowering the center of gravity of the club head. This weighting structure increases the length of the arm of force of the club (increase impact force of the club face) and enhances the interaction between the club head and the golf ball at the instant of striking. The arrangement of the present invention increases the acceleration of gravity of the golf ball relative to the face, prevents the golf ball from slipping upon impact with the face, and prevents the position of the gravitational center from deviating excessively from the club head, thereby inhibiting the generation of resistance during striking and the tendency of the golf club to twist in the player's hand.

In present invention, the neck of the club head extends from the shaft mount to a lower rim of the sole of the club head and straddles the lower rim of the sole of the club head, and a projecting neck weighting of any form can be provided at the neck near the shaft mount. A weight chamber is further disposed at a central portion of the neck for accommodating a weight of any form.

DETAILED DESCRIPTION OF THE PREFERRED EMBODIMENT

The object of the present invention is to prevent possible slippage between the golf ball and the face of the golf club during striking, which slippage can cause the golf ball to deviate from the best flight path. The principle on which the solution to this problem is based is to increase the interaction between the golf ball and the face by augmenting the frictional force on the club face with the acceleration of the gravitational force to assist in overcoming inertia, so as to prevent the golf ball from slipping or displacing on the face of the golf club.

Figure 1:
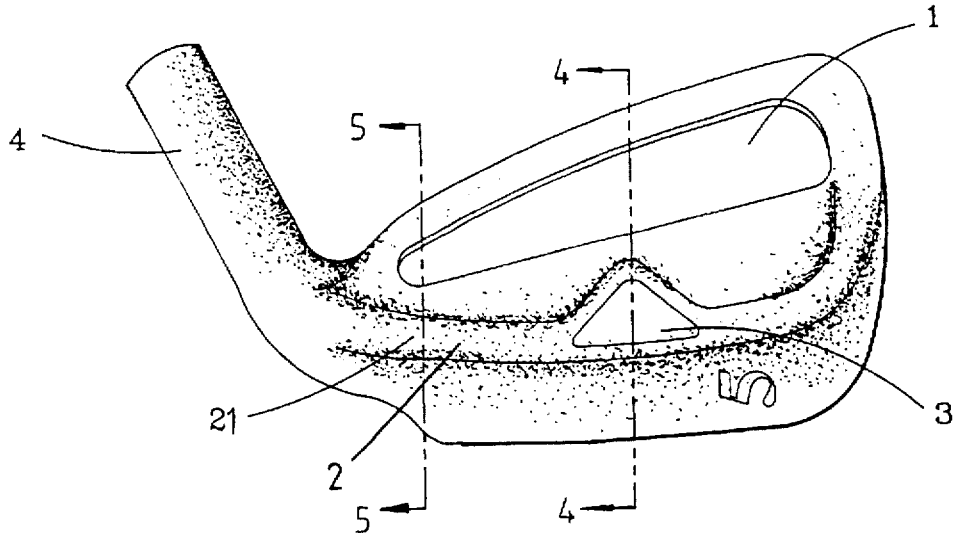
FIG. 1 is a schematic elevational view of the present invention.
Figure 2:
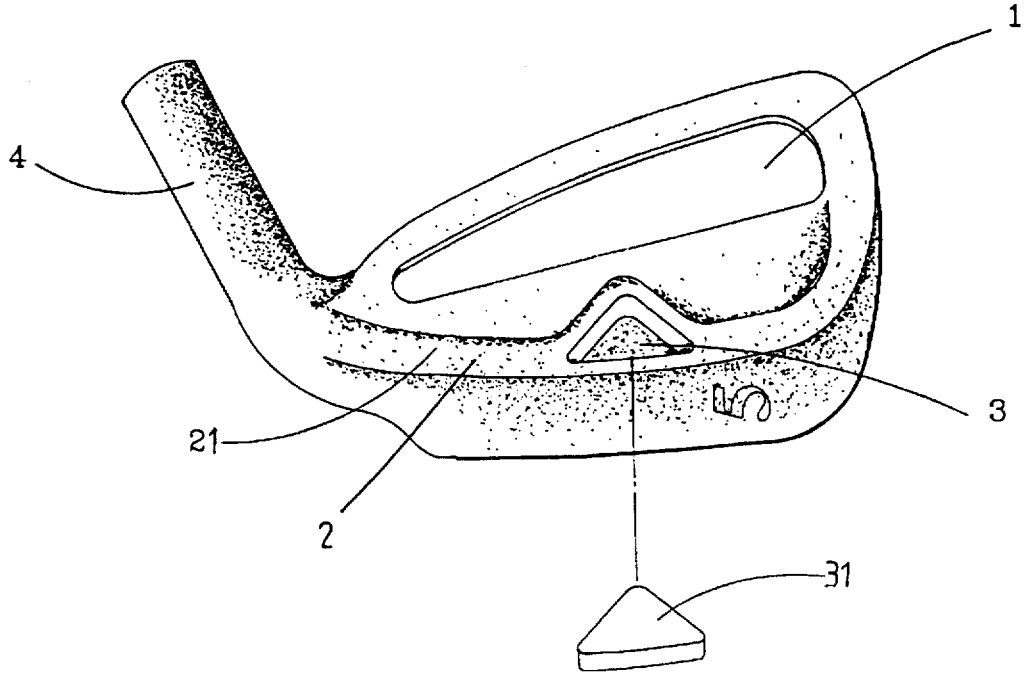
FIG. 2 is an exploded elevational view of FIG. 3 of the present invention.
Figure 3:
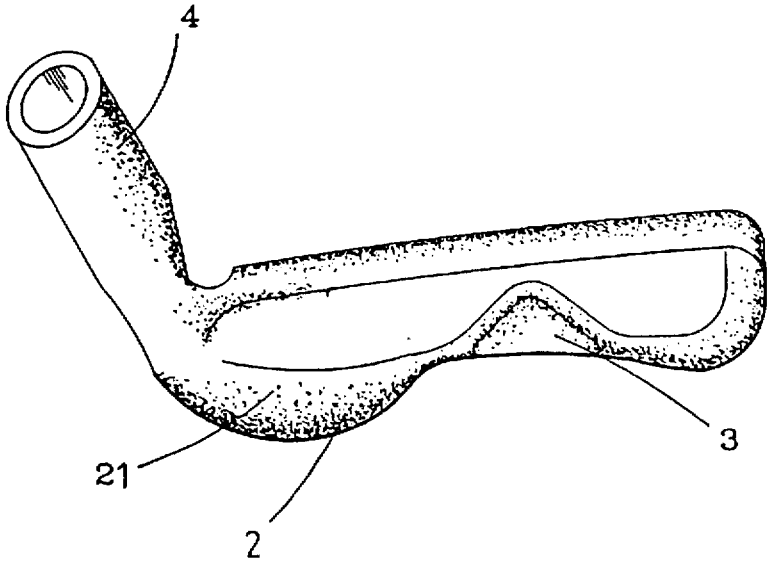
FIG. 3 is a schematic top view of present invention.
Figure 4:
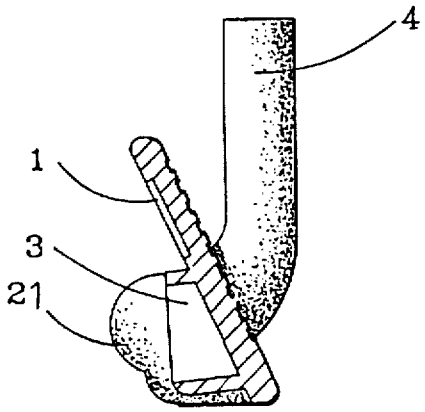
FIG. 4 is a sectional view taken along line 4—4 of FIG. 1.
Figure 5:
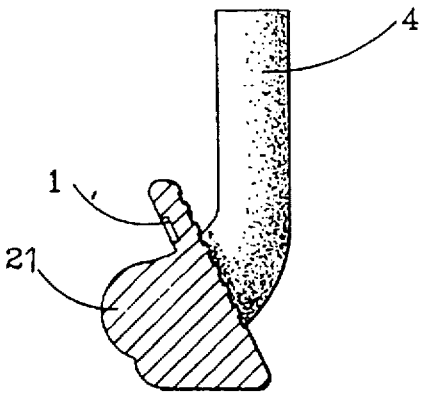
FIG. 5 is a sectional view taken along line 5—5 of FIG. 1.

With reference to FIG. 1, the present invention essentially comprises a club head 1, a neck 2, a weight chamber 3, a weight 31 and a shaft mount 4. The neck 2 extends from the shaft mount 4 to a lower rim of sole of the club head 1 with a neck weighting 21 of any form projecting therefrom. Referring to FIG. 2, as the weight 31 is used to adjust the position of the gravitational center of the club head 1 according to the of the neck weighting 21, so that weights 31 of various mass may be selected to match the neck 21. With reference to FIG. 3, the neck weighting 21 is a projection of any form. In order to clearly illustrate the feature of the present invention, FIG. 4 shows the position of the weight chamber 3, while FIG. 5 illustrates the position of the neck weighting 21. From FIGS. 4 and 5, it can be seen that the respective positions of the neck weighting 21 of the neck 2 and the weight chamber 3 are at the lower rim of the club head 1, so as to effectively lower the gravitational center of the club head 1 and increase the arm of force (impact force) of the golf club. This structure enables the golf player to easily control the club head 1, while permitting the gravitational center of the club head 1 to move precisely along the ground surface. Furthermore, in order to prevent the neck weighting 21 from deviating from the gravitational center of the club head 1, the weight chamber 3 is disposed at a central position at the lower rim of the club head 1. It is not necessary for the weight chamber 3 to have a specific shape, so long as it can function to adjust the gravitational center and to reinforce the weight of the club head 1.

Figure 6:
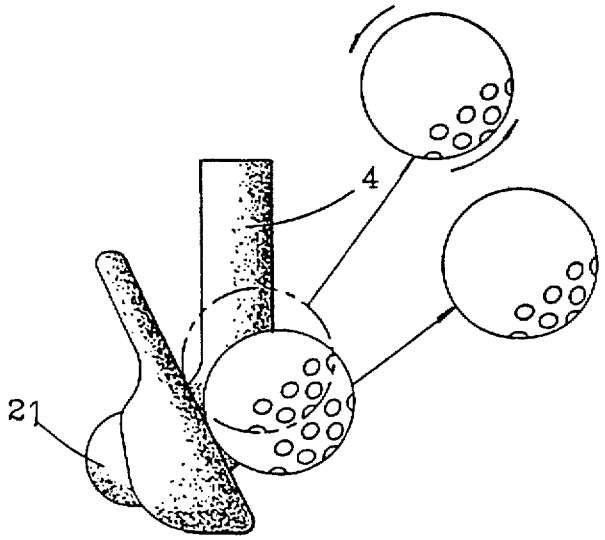
FIG. 6 is a schematic view illustrating the present invention in a striking state.
Figure 7:
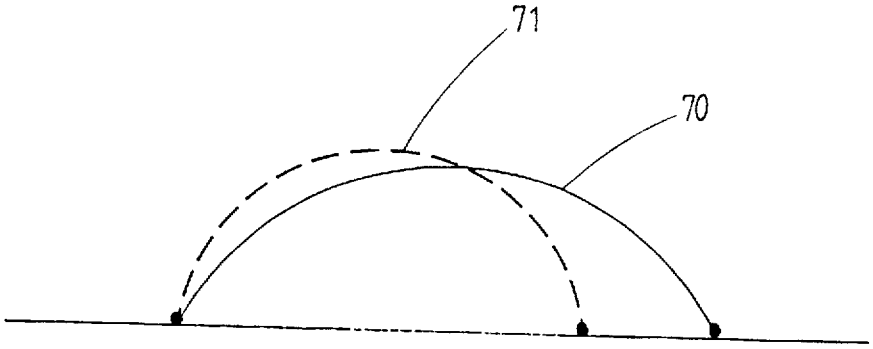
FIG. 7 is a schematic view of the simulated path of the golf ball when struck.

In FIG. 6 the solid lines represent the situation where there is no slippage occurred during striking of the golf ball, the golf ball flies outwardly at an angle relative to the angle of incidence. For example, if the angle contained between the face 11 and the ground surface is 22.5°, the golf ball will fly outwardly at an angle of 45°, thus achieving a farthest flying distance. The imaginary lines (dashed line) represent the situation in which there is some slipping during striking, so that the angle of elevation when the golf ball flies outwardly is excessive. When the golf ball is struck by the club face, the friction between the face 11 and the golf ball causes the golf ball to turn counterclockwise. With this type of spin and based on Bernoulli's law, the flow of air above the golf ball will increase giving the golf ball a lifting force. From FIG. 7, it can be seen that a farthest flying distance can be achieved if there is no slipping and the golf ball is struck out at an elevational angle of 45°, as shown by solid line 70. On the other hand, if the golf ball slips when struck, the golf ball cannot be travel at an elevational angle of 45° and the golf ball will rotate in a counterclockwise direction, so that the golf ball will tend to fly upwardly, as shown by the dashed line 71. Thus, the energy obtained at the impact of the club head 1 is wasted by the rotation of the golf ball, which shortens the flying distance of the golf ball.

Furthermore, the present invention has taken into consideration that some players may strike the golf ball prematurely, so that the angle of elevation of the golf ball is excessive. In order to prevent or reduce the problems associated with such premature striking of the golf ball, the joint connecting the neck 2 and the shaft mount is constructed to have a substantially S-shape, which holds the neck 2 and the shaft mount at different elevations. With this structure, the neck weighting 21 provided at the neck 2 causes the face 11 to shrink rearwardly, so as to delay the time of impact at striking.

Figure 8:
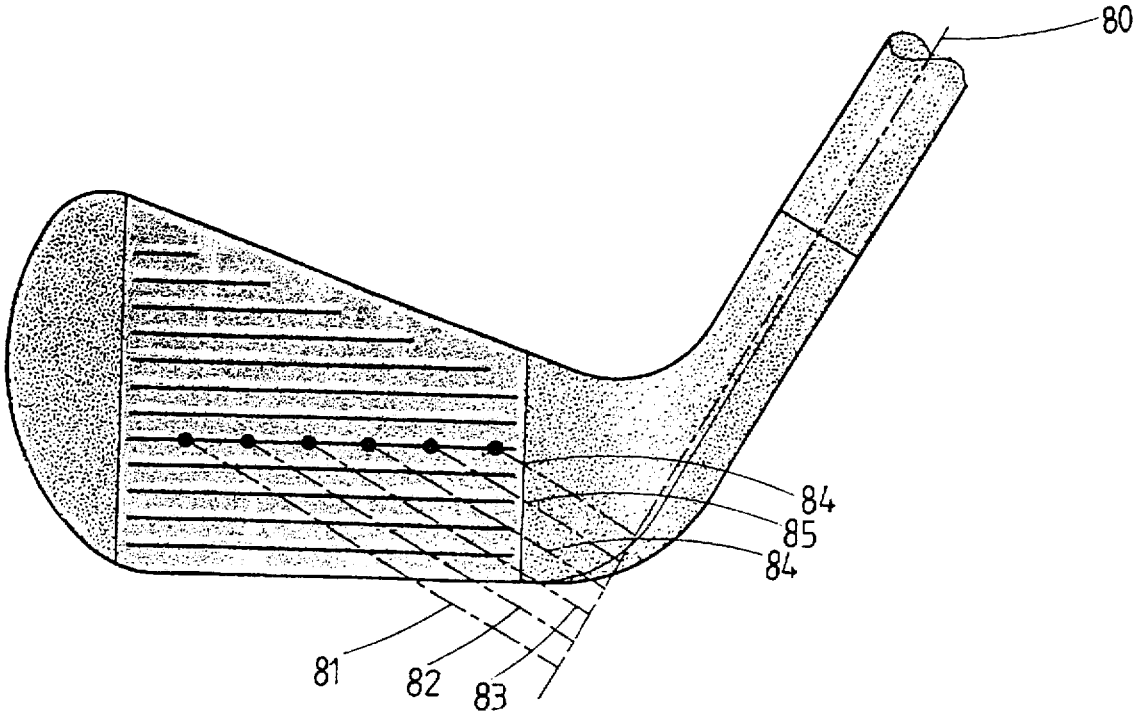
FIG. 8 is a schematic view showing the arms of torsional force of various points of stroke.

With reference to FIG. 8, it can be seen that when the gravitational center deviates too much from the extended line 80 of the golf club, there will be changes in the torsional force at the instant of striking. This is because the distance from the gravitational center to the extended line 80 effects or changes the torsional force. This distance is shown by dashed lines 81–86 in FIG. 8. The shorter the distance, the smaller the torsional force. The present invention is also directed to drawing the gravitational center of the club head near the extended line of the golf club shaft.

In summary, the present invention includes both neck weighting and a weight chamber in the golf club head to lower the gravitational center of the club head 1 and lengthen the arm of force (increase impact force). This arrangement enhances the interaction between the club head 1 and the golf ball and prevents the golf ball from slipping upon impact. In addition, the face is moved slightly rearward so as to delay the time of impact to achieve a precise striking position.

Although the present invention has been illustrated and described with reference to the preferred embodiment thereof, it should be understood that it is in no way limited to the details of such embodiment but is capable of numerous modifications within the scope of the appended claims.

I claim:

1. A golf club having an improved neck weighting structure comprising a club head with a front side, a sole, a neck, a weight chamber, and a shaft mount, said front side of said club head including a face of uniform thickness, said shaft mount is cylindrical and adapted for receiving and positioning a shaft, said neck of said club head extending from said shaft mount towards a lower rim of said sole of said club head and straddling said sole of said club head and adapted to lower the gravitational center of said club head, a neck weighting projecting from said neck near said shaft mount, said neck weighting for moving the gravitational center to an extended line of the golf club, and said weight chamber is disposed at a central position of said neck for accommodating weights of different mass for correcting the gravitational center of said club head when the gravitational center deviates from a predetermined area.

2. An improved neck weighting structure as claimed in claim 1, wherein a joint between said neck and said shaft mount is configured to have a substantially S-shape for holding said neck and said shaft mount at different elevations.

* * * * *